United States Patent [19]

Rijnders

[11] Patent Number: 4,781,005

[45] Date of Patent: Nov. 1, 1988

[54] CEILING PANEL CARRIER ADAPTER MEMBER

[75] Inventor: Willem Rijnders, Papendrecht, Netherlands

[73] Assignee: Hunter Douglas International N.V., Curacao, Netherlands Antilles

[21] Appl. No.: 43,911

[22] Filed: Apr. 29, 1987

[30] Foreign Application Priority Data

Apr. 28, 1987 [GB] United Kingdom ..... 8709964

[51] Int. Cl.[4] ..... E04B 5/52

[52] U.S. Cl. ..... 52/489; 52/484

[58] Field of Search ..... 52/484, 489

[56] References Cited

U.S. PATENT DOCUMENTS

| | | | |
|---|---|---|---|
| 3,313,075 | 4/1967 | Buchmeler . | |
| 3,807,114 | 4/1974 | Ollinger . | |
| 4,041,668 | 8/1977 | Jahn et al. . | |
| 4,157,000 | 6/1979 | Sutter | 52/489 |
| 4,245,446 | 1/1981 | Judkins | 52/484 X |
| 4,270,327 | 6/1981 | Van Leeuwen | 52/484 |
| 4,272,937 | 6/1981 | Brugman . | |
| 4,361,996 | 12/1982 | Smith | 52/484 |
| 4,448,006 | 5/1984 | Worley . | |
| 4,483,116 | 11/1984 | Gailey | 52/484 |
| 4,580,382 | 4/1986 | Judkins et al. | 52/484 X |

FOREIGN PATENT DOCUMENTS

| | | |
|---|---|---|
| 1860794 | 8/1962 | Fed. Rep. of Germany . |
| 1204801 | 11/1965 | Fed. Rep. of Germany . |
| 67231 | 6/1969 | Fed. Rep. of Germany . |
| 658374 | 10/1951 | United Kingdom . |
| 925962 | 7/1958 | United Kingdom . |
| 854243 | 11/1960 | United Kingdom . |
| 994672 | 6/1965 | United Kingdom . |
| 1098613 | 1/1968 | United Kingdom . |

*Primary Examiner*—Carl D. Friedman

*Attorney, Agent, or Firm*—Pennie & Edmonds

[57] ABSTRACT

An adapter for use with a support grid for ceiling elements. In particular the adapter mounts on a horizontal bottom portion of an inverted T-shaped support. The adapter has a first flange forming a C-shaped clip. A plurality of such flanges are spaced along the adapter length so they do not interfere with cross-support members. Second flange portions support the ceiling elements. Additionally, third flange portions are provided to prevent transverse movement of the adapter relative the support. The third flange portions are also spaced to prevent interference with cross supports.

14 Claims, 3 Drawing Sheets

CEILING PANEL CARRIER ADAPTER MEMBER

BACKGROUND OF THE INVENTION

The invention relates to a panel carrier and to a grid system for such panels.

The prior art has provided various types of panel arrangements incorporating elongated spaced apart panels which are connected by various forms of panel carriers to a suitable structure. Many panel carriers presently on the market are unduly complex. In addition, most panel carriers presently in use are not suitable for use as replacements for existing carriers.

Carrier adapters are known which fit over a horizontal flange on a ceiling carrier or a support member having a horizontal flange. In particular U.S. Pat. No. 4,157,000 to Sutter shows a mounting device for a ceiling member. The device is an elongated adaptor strip with tabs punched out of a horizontal portion of the adaptor. The tabs secure decorative panels to inverted T-shaped ceiling grid support assemblies. The adaptor has a c-shape which clips onto a horizontal flange of the existing grid.

The Sutter type clip however is arranged so the weight of the decorative panels can cause the c-shape to open this loosening the connection to the grid. Furthermore there is no positive prevention of the clip being moved off the grid. Further Sutter does not touch or give a solution for the issue of a possible interference of transverse grid supporting member with adapter(s) when the adapters are used with crosslinking grid supports. Such grid support assemblies are mostly used for several ceiling types to meet building requirements in respect of fire resistance and strength or as part of tile grid ceilings supporting the tile elements.

This problem does not occur if a plurality of adapters are used that each have a length to fit in between subsequent transverse grid members such as known in U.S. Pat. No. 4,361,996 to Smith. Such construction requires a large number of short length adaptors and makes installing cumbersome and laborous.

SUMMARY OF THE INVENTION

According to one aspect of the invention, an improved adapter member for attachment of a ceiling panel to a support structure is provided. The ceiling structure has a support grid which includes main support members and cross support members. Adapters are used to support a plurality of ceiling elements on the grid. The support members have a bottom portion which has a longitudinally extending lower surface and a sideways extending longitudinal free edge. The adapter includes an elongated body portion for perimeter engagement with the lower surface of the support member. The adapter also has an upwardly directed arm means which bends over the top of the body portion to define a clip means for attaching the adapter member to the longitudinal free edge of the support member.

To connect the ceiling elements to the adapter, the adapter includes downwardly directed ceiling element attaching means for engaging with the ceiling elements. This engagement attaches the element to the ceiling support member in a way not interfering with the clip clamping action.

The arm means includes a plurality of first flange portions spaced along one side of the elongated adapter member. The spaces between the first flange portions are correlated with the pitch or location and dimension of the cross support members which are connected to the support member at the relevant side. Thus the first flange portions do not interfere with the cross-supports.

The downwardly directed ceiling elements attaching means includes a plurality of second flange portions spaced along the same side of the elongated adapter member as the first flange portions. The second flange portions are positioned so their location does not coincide with the first flange portions. Each of the second flange portions have engaging means for holding at least one of the edges of the ceiling element.

The adapter may be further improved by having a body width which is at least equal to the width of the bottom portion of the support member. The side of the adapter member body portion opposite the one side having the first and second flange portions has upturned, spaced third flange portions. The third flange portions limit or prevent transverse movement of the adapter member with respect to the support member. The spaces between the third flange portions may be sized and located to snuggly accommodate the cross-supports with little or no play in the longitudinal direction of the adapter member.

The number of third flange portions can be the same as the first flange portions but is preferably greater than the number of first flange portions, some of the third flange portions then being arranged immediately opposite the first flange portions and other third flange portions being arranged therebetween, as considered longitudinally of the body portion.

Through this arrangement the adapter member can be adjusted lengthwise in respect to the support member to vary the position of the engaging means in respect of that support member and still be fixedly held in such selected position. Adaptation of the ceiling element distribution in respect of the surface to be covered is therewith possible in a limited way. Based on the U.S. standard inverted T-shape support structures the best mode has the center-to-center distance of the spaces between the third flange portions fixed at two inches.

With such a construction of the adapter member one can easily and safely fit the adapter member(s) to support members of the ceiling support and use adapter members of considerable length including a length equal to or exceeding the length of the relevant support member.

It will be appreciated that the adapter member of the present invention can be used with a wide variety of different support members provided that these support members each have at least one longitudinally extending lower part having a longitudinally extending lower surface and a lateral longitudinally extending free edge.

Preferably the support members with which the adapter of the present invention is to be used are of inverted T-cross section but an L-cross section, an I-cross section, a top has cross section and many other suitable cross sections in which, in essence, a horizontal flange extends laterally to have a free edge may be employed.

DESCRIPTION OF THE PREFERRED EMBODIMENT

Figure 1:
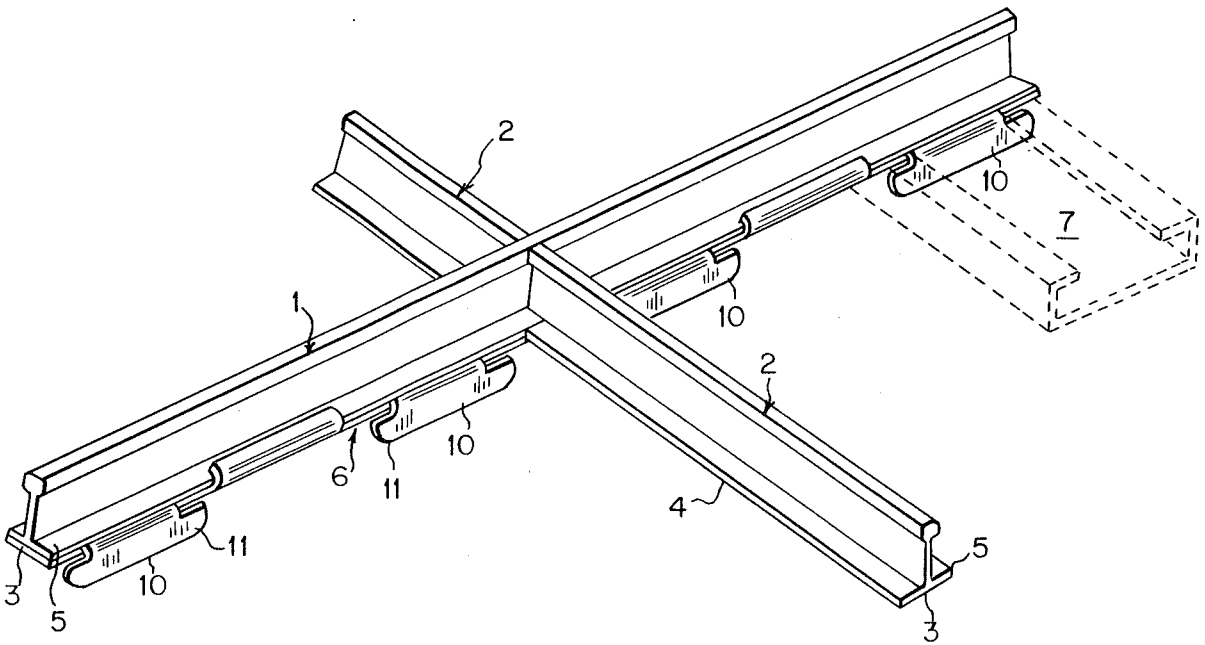
FIG. 1 is a perspective view from one side of a portion of a ceiling grid having the adapter of the invention in place.
Figure 3:
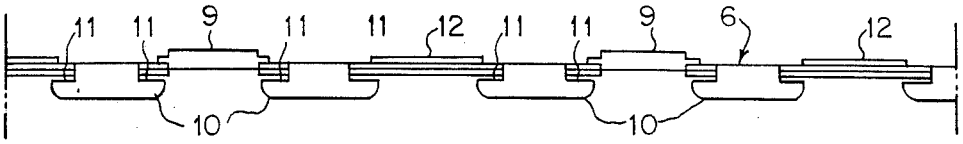
FIG. 3 is a side view of the adapter.
Figure 4:
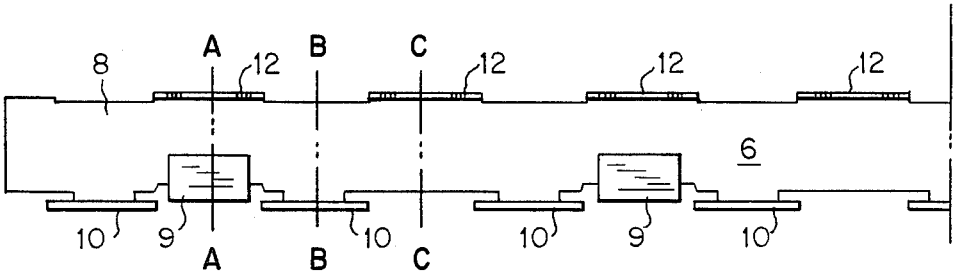
FIG. 4 is a top view of the adapter of FIG. 3.
Figure 5:
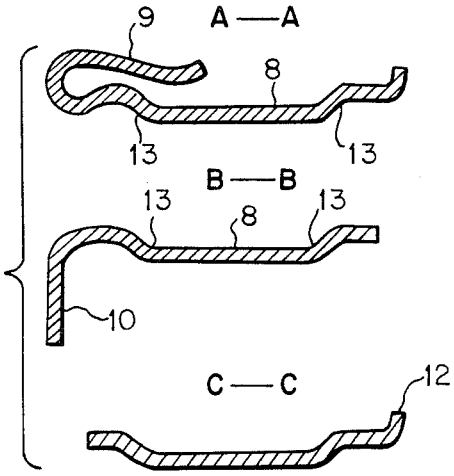
FIG. 5 shows the cross-sectional configuration of the adapter along the lines indicated in FIG. 4.

Referring to FIG. 1 there is shown part of a support grid having support grid main support members 1 and cross-support members 2. Each of the support members has a bottom portion 3 with a longitudinally extending lower surface 4. The bottom portions also include a longitudinal sideways extending free edge 5. An adapter 6 is used to connect a plurality of ceiling elements 7 to the support grid and thereby support the ceiling elements 7. The adapter is shown in more detail in FIGS. 3, 4 and 5. The adapter 6 has an elongated body portion 8 which engages and is parallel to lower surface 4. The adapter has an upwardly directed arm means in the form of first flange portions 9 which bends over body portion 8 to define a clip means for attaching the adapter 6 to the free edge 5.

The adapter 6 also has downwardly directed ceiling element attachment means in the form of second flange portions 10 along the same side as first flange portions 9. Second flange portions 10 have ceiling element engaging means 11 in the form of arms which engage the ceiling element. Alternatively they could engage only one edge of a ceiling element, with another of the engaging means engaging the other element-edge, dependable on the type of ceiling element and/or engaging means, as are common to the art.

The first flange portions 9 are spaced along the length of the adapter. The spaces are correlated with the pitch or location and dimension of the cross support members 2 such that the first flange portions 9 do not interfere with the cross-support 2. This spacing may be advantageously chosen so the first flange portions are spaced by a dimension greater than the dimension of the first flange portions 9 itself in the longitudinal direction. This size may be chosen as four inches for a standard U.S. grid system where the separation of adjacent cross-members is one foot or a multiple thereof.

Figure 2:
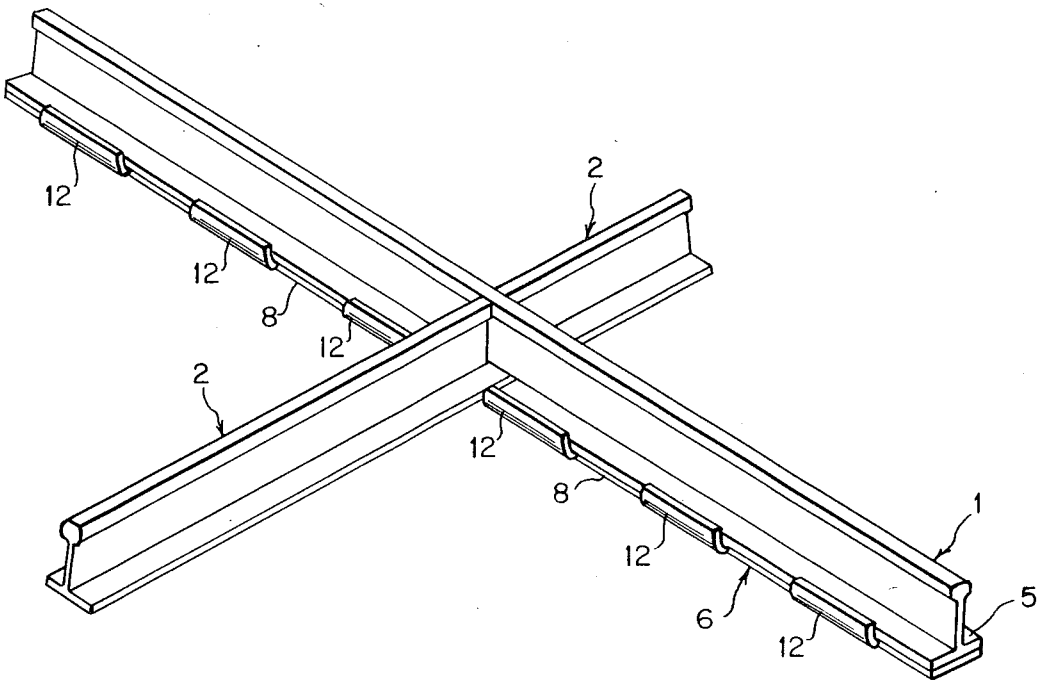
FIG. 2 is a perspective view from the other side of the portion of FIG. 1.

The adapter 6 is preferred to have a width at least equal to the width of bottom portion 3 of the support member. As shown in FIG. 2 the adapter 6 has third flange portions 12 which are on the side opposite the first and second flange portions. The third flange portion 12 is upturned and limits the transverse movement of the adapter relative to the support member. The third flange portions 12 are also spaced. Preferably this spacing is dimensioned so cross-supports 2 are snuggly accommodated in the spaces with little or no play in the longitudinal direction of the adapter 6. The center-on-center spacing of the third flanges is two inches for standard U.S. grid system where the separation of adjacent cross members is one foot or a multiple thereof.

Preferably, the spacing of the first flange portions and third flange portions is such that a plurality of spaces between third flange portions occur along the length between two adjacent first flange portions. It is further preferred to have the transverse position of each first flange portion coincide with that of a third flange portion.

The adapter may be stiffened by providing a plurality of ridges 13 extending along its length.

I claim:

1. An adapter member for attaching a ceiling panel element to a support member of a ceiling construction comprising:

(a) a ceiling support grid including main support members and cross-support members;

(b) a plurality of ceiling elements; and (c) adapter members for connecting the elements to support members of the support grid, which support members have a bottom portion comprising a longitudinally extending lower surface and a sideways extending longitudinal free edge and, which adapter members include opposite elongated side edges and a central elongated body portion for parallel engagement with the lower surface of the support member, upwardly directed arm means bent over on top of the body portion to define clip means for attaching the adapter member to the longitudinal free edge of the support member and downwardly directed ceiling element attachment means for engaging with the ceiling elements to attach the elements to the ceiling support member, the improvement wherein:

(i) the arm means includes a plurality of first flange portions spaced along one side edge of the elongated adapter member, the spaces between the first flange portions being correlated with the pitch and dimension of the cross-support members that are connected to the main support member at the relevant side as not to interfere therewith;

(ii) the downwardly directed ceiling elements attaching means includes a plurality of second flange portions spaced along the one side edge of the elongated adapter member over the full length thereof at locations different from any of the first flange portions, each of said second flange portions having engaging means for holding at least one of the edges of a ceiling element.

2. The improvement in the adapter member according to claim 1 wherein the elongated body portion has a width at least equal to the width of the bottom portion of the support member with the side edge of the adapter member body portion opposite said one side edge having upturned spaced third flange portions extending along an opposite longitudinal side of the support member, so as to limit any transverse movement of the adapter member with respect to the support member.

3. The improvement in the adapter member according to claim 2 wherein the spaces between the third flange portions are positioned as to correlate with the pitch of the cross-support members connected to the support member at the relevant side and are each dimensioned to snuggly accommodate any such cross-support member with little play in the longitudinal direction of the adapter member.

4. The improvement in the adapter member according to claim 2 or 3 and for use with a ceiling construction in which the pitch of subsequent standard U.S. inverted T-shaped cross-support members is one foot or the multiple thereof, wherein the center-on-center distance of the spaces between the third flange portions is two inches.

5. The improvement in the adapter member according to any one of the claims 1–3 and for use with a ceiling construction in which the pitch of subsequent standard U.S. inverted T-shaped cross-support members is one foot or the multiple thereof, wherein the center-on-center distance of the first flange portions is four inches.

6. The improvement in the adapter member according to any one of the claims 1–3 wherein the transverse position of each first flange position coincides with that of a third flange portion.

7. A suspended ceiling comprising a support grid including main support members and cross-support members of inverted T-shape, a plurality of ceiling elements and a plurality of adapter members for connecting the elements to support members of the support grid, the adapter members being in accordance with any one of the claims 1–3 and the side edges of the adapter members extending horizontally between each of said flange portions for engaging along the lower surface of the T-shaped support member and the cross-support members.

8. The improvement in the adapter member according to claim 1 wherein the spacing-distance between subsequent and adjacent first flange portions is substantially greater than the dimension of each of said flange portions in the longitudinal direction of the adapter member.

9. The improvement in the adapter member according to claim 1, wherein over the length of a space between two adjacent first flange portions on the one side edge of the adapter member there are plurality of third flange portion-spaces over the corresponding length at the other side edge of the adapter member.

10. A ceiling panel carrier adapter member for attaching a ceiling panel to the inverted T-shaped support member of an existing grid ceiling construction wherein said ceiling panel is elongated with opposite inturned flanges facing each other along its length for attachment to said adapter member, said T-shaped support member includes a vertical web and a lower surface defined by oppositely directed flanges at the bottom of the web and said adapter member includes opposite elongated side edges and a central elongated body for engaging along the lower surface of the T-shaped support member, upwardly directed arm means for attaching the adapter member to the support member and downwardly directed panel attaching means for engaging with the ceiling panel to attach the panel to the T-shaped support member, the improvement wherein:

(a) the arm means includes a plurality of first flange portions spaced along one side edge of the elongated adapter member and bent over on top of the body thereof to define clip sections for attachment along the length of one of the flanges of the T-shaped support member;

(b) the downwardly directed panel attaching means includes a plurality of second flange portions spaced along the one side edge of the elongated adapter member at locations between the first flange portions, each of said second flanges portions having engaging means for supporting each of the inturned flanges of the ceiling panel.

11. The improvement in the carrier adapter member according to 10 wherein:

(a) the elongated body has a width about equal to the width of the oppositely direction flanges of the T-shaped support member with the side edge of the body opposite said one edge having an upturned third flange portion engaging the other flange of the T-shaped support member.

12. The improvement in the carrier member adapter according to claim 10 wherein:

(a) the body thereof includes a plurality of ridges extending along the length thereof for increasing its stiffness.

13. The improvement in the carrier adapter member according to any one of claims 10–12 wherein:

(a) the spacing of the first flange portions along the one side edge of the adapter member is correlated with the spacing of any cross-supports connected between and extending at right angles to the T-shaped support members as not to interfere therewith; and (b) said side edges of the adapter member extend horizontally between each of said flange portions for engaging along the lower surface of the T-shaped support member and any cross-supports.

14. The improvement in the carrier adapter member according to claim 13 wherein:

(a) the third flange portion includes a plurality of such portions spaced from each other similarly to the spacing of the first flange positions.

* * * * *